US005224772A

United States Patent [19]

Fustos

[11] Patent Number: 5,224,772

[45] Date of Patent: Jul. 6, 1993

[54] ILLUMINATED DIVE MASK

[76] Inventor: Vincent E. Fustos, 171 S. Oakdale Ave., Hermitage, Pa. 16148

[21] Appl. No.: 970,381

[22] Filed: Nov. 2, 1992

[51] Int. Cl.[5] ..... F21L 15/14

[52] U.S. Cl. ..... 362/105; 362/103; 362/157; 2/428

[58] Field of Search ..... 362/103, 105, 106, 157, 362/227, 236, 253; 2/428

[56] References Cited

U.S. PATENT DOCUMENTS 1,752,120 3/1930 Taylor ..... 362/106
2,320,222 5/1943 Crupi ..... 362/106
4,254,451 3/1981 Cochran, Jr. ..... 362/103
4,638,410 1/1987 Barker ..... 362/105

*Primary Examiner*—Richard R. Cole
*Attorney, Agent, or Firm*—Leon Gilden

[57] ABSTRACT

A dive mask includes a mask lens mounted within a mask rim, with the dive mask further having a continuous flexible mask skirt for securement to an individual's face for sealing engagement therewith. The mask has a top wall having fixedly secured thereto an illumination housing, including a plurality of lenses therein operative in communication with a battery member to effect illumination of a plurality of illumination bulbs within the illumination housing.

4 Claims, 4 Drawing Sheets

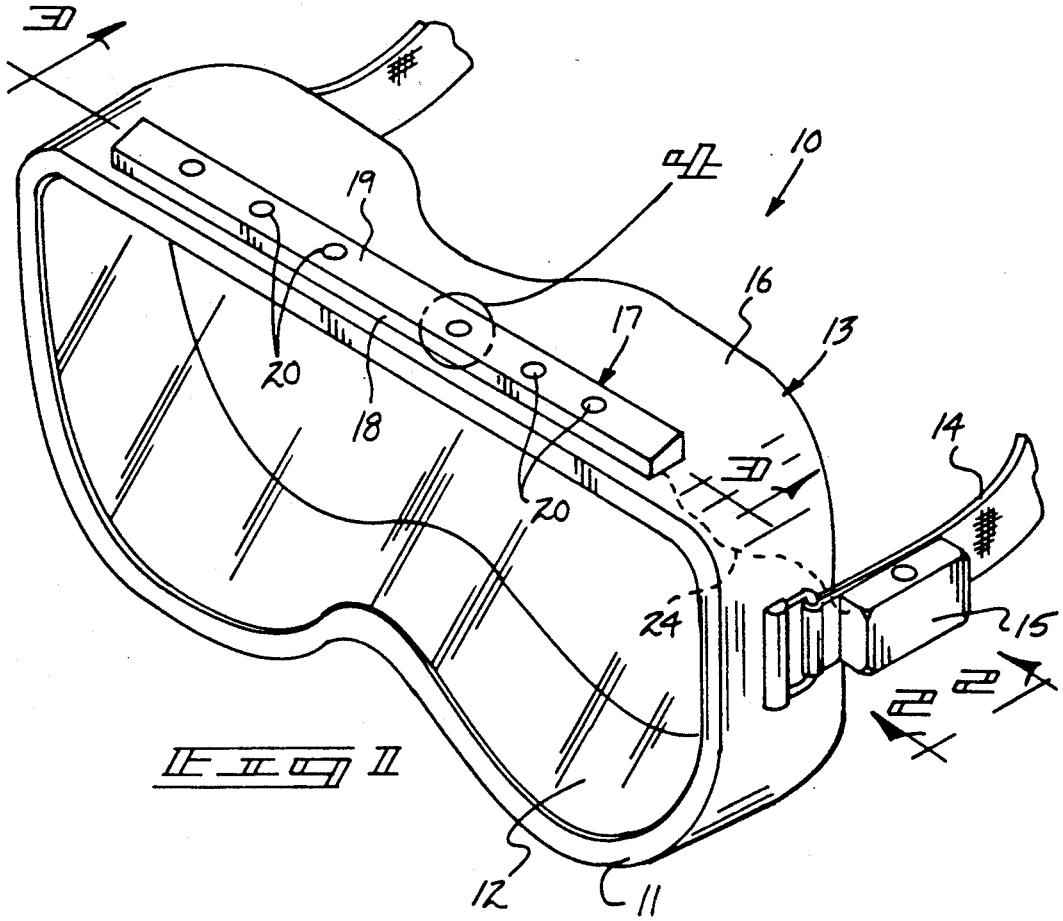
FIG 1
FIG 2
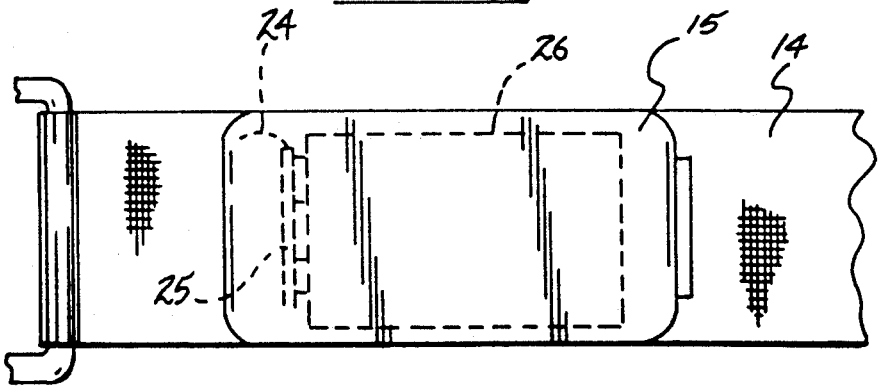

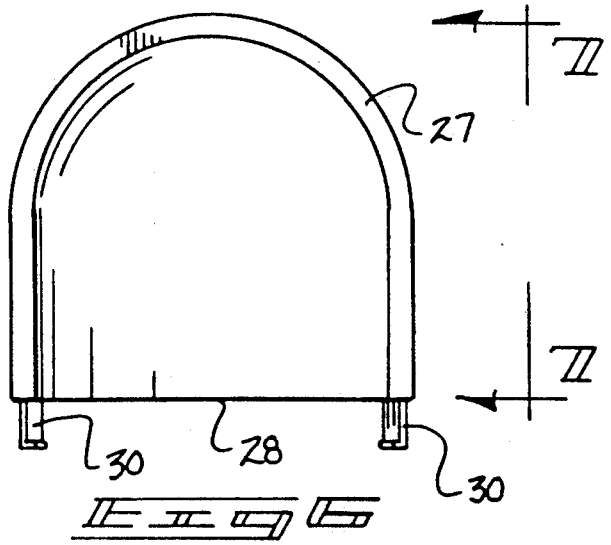
FIG 6
FIG 7
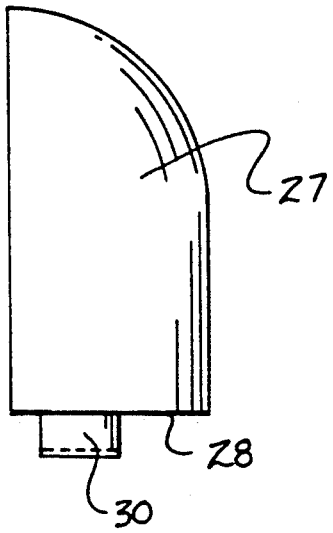
FIG 8
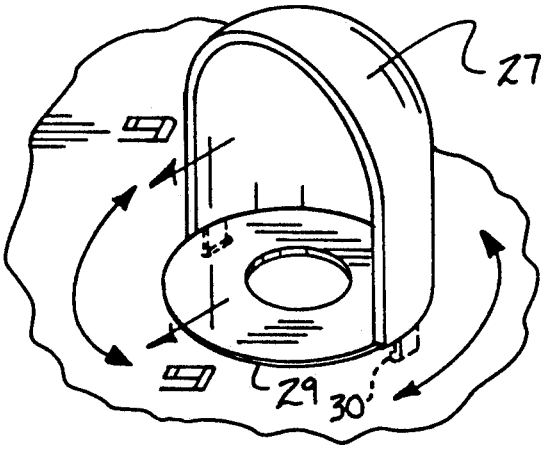

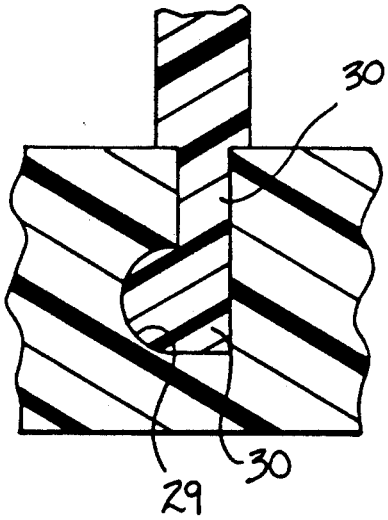
Fig 9
Fig 10
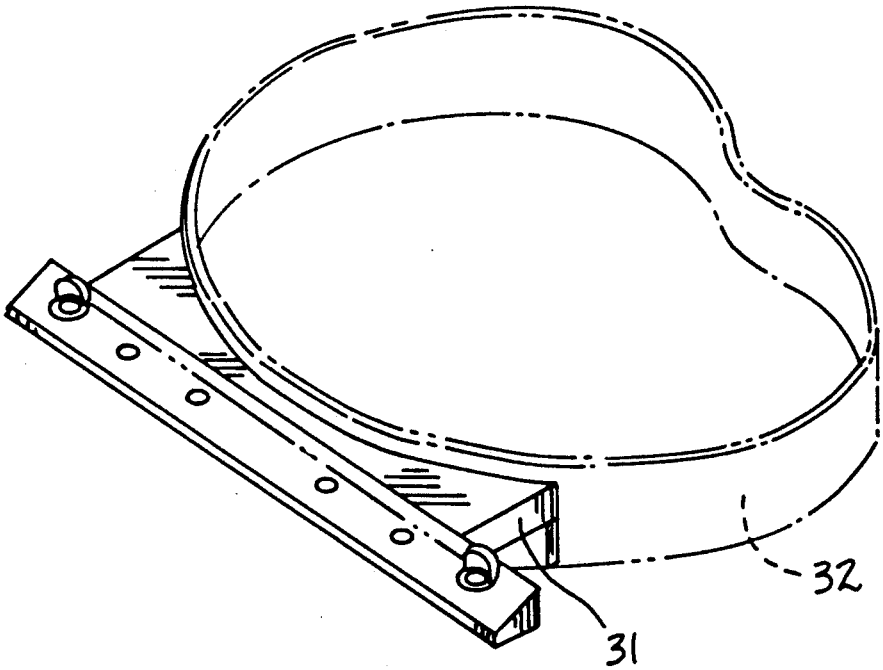

ILLUMINATED DIVE MASK

BACKGROUND OF THE INVENTION

1. Field of the Invention

The field of invention relates to dive mask structure, and more particularly pertains to a new and improved illuminated dive mask wherein the same is arranged to project illumination therefrom.

2. Description of the Prior Art

Dive masks of various types have been availed in the prior art and are of various configurations such as indicated in U.S. Pat. Nos. 4,077,068; 3,725,953; 4,856,120; and 3,672,750.

The instant invention attempts to overcome deficiencies of the prior art by employing an illumination structure relative to the mask arrangement to project illumination relative to the mask and in this respect, the present invention substantially fulfills this need.

SUMMARY OF THE INVENTION

In view of the foregoing disadvantages inherent in the known types of dive mask structure now present in the prior art, the present invention provides an illuminated dive mask wherein the same is directed to the projection of illumination from the mask by employing an illumination housing operative through a battery pack mounted to the securement strap of the mask structure. As such, the general purpose of the present invention, which will be described subsequently in greater detail, is to provide a new and improved illuminated dive mask which has all the advantages of the prior art dive mask apparatus and none of the disadvantages.

To attain this, the present invention provides a dive mask including a mask lens mounted within a mask rim, with the dive mask further having a continuous flexible mask skirt for securement to an individual's face for sealing engagement therewith. The mask has a top wall having fixedly secured thereto an illumination housing, including a plurality of lenses therein operative in communication with a battery member to effect illumination of a plurality of illumination bulbs within the illumination housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated dive mask which has all the advantages of the prior art dive mask apparatus and none of the disadvantages.

It is another object of the present invention to provide a new and improved illuminated dive mask which may be easily and efficiently manufactured and marketed.

It is a further object of the present invention to provide a new and improved illuminated dive mask which is of a durable and reliable construction.

An even further object of the present invention is to provide a new and improved illuminated dive mask which is susceptible of a low cost of manufacture with regard to both materials and labor, and which accordingly is then susceptible of low prices of sale to the consuming public, thereby making such illuminated dive masks economically available to the buying public.

Still yet another object of the present invention is to provide a new and improved illuminated dive mask which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an orthographic view, taken along the lines 2—2 of FIG. 1 in the direction indicated by the arrows.

FIG. 6 is an orthographic view of a reflection hood utilized by the invention.

FIG. 7 is an orthographic view, taken along the lines 7—7 of FIG. 6 in the direction indicated by the arrows.

FIG. 8 is an isometric illustration of the reflection hood mounted to the top wall of the illumination housing.

FIG. 9 is an orthographic view, taken along the lines 9—9 of FIG. 8 in the direction indicated by the arrows.

FIG. 10 is an isometric illustration of the illumination housing mounted to a flexible band.

DESCRIPTION OF THE PREFERRED EMBODIMENT

Figure 5:
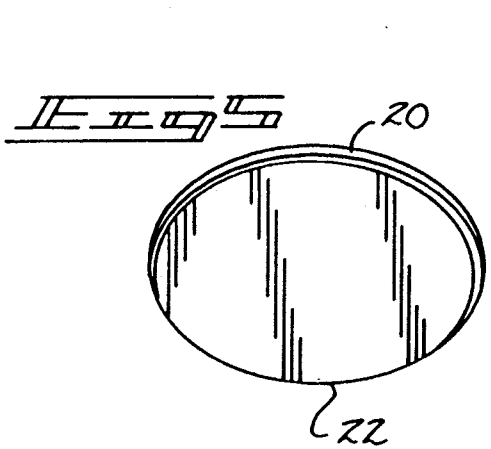
FIG. 5 is an isometric illustration of section 5, as set forth in FIG. 4.
Figure 3:
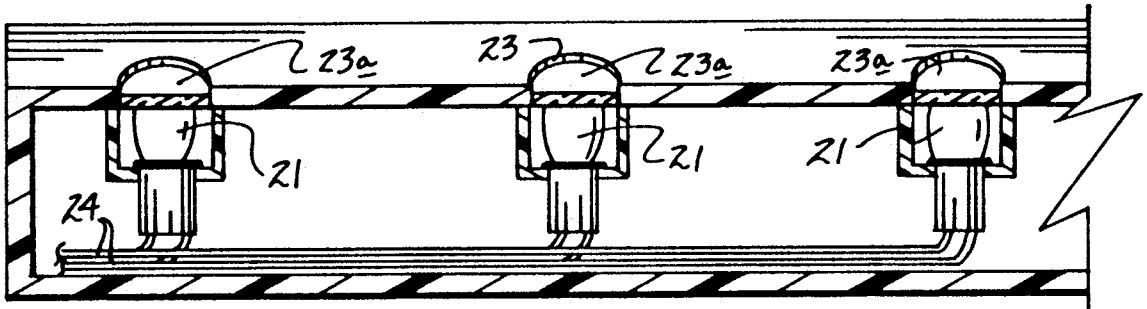
FIG. 3 is an orthographic view, taken along the lines 3—3 of FIG. 1 in the direction indicated by the arrows.
Figure 4:
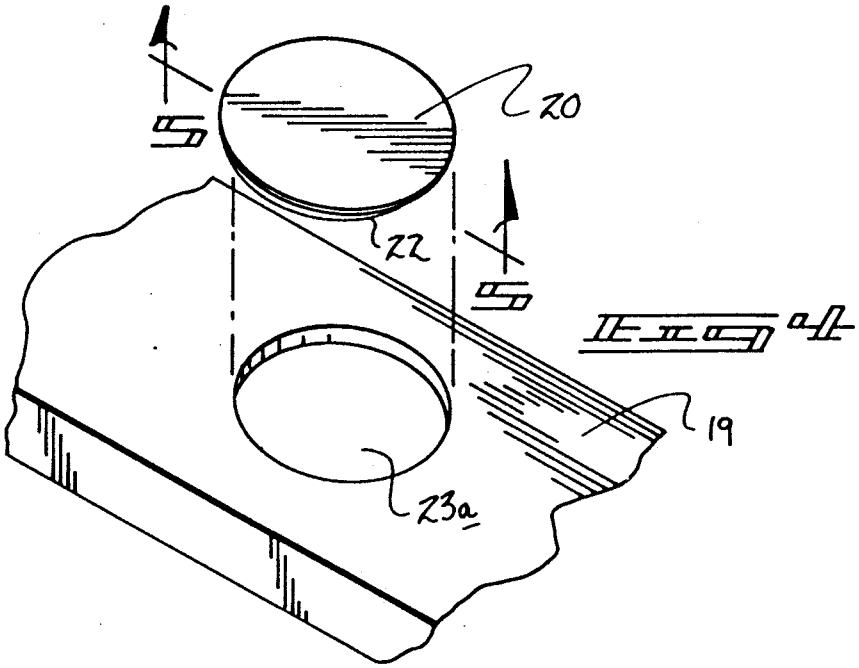
FIG. 4 is an isometric illustration of section 4, as set forth in FIG. 3, in an enlarged view.

With reference now to the drawings, and in particular to FIGS. 1 to 10 thereof, a new and improved illuminated dive mask embodying the principles and concepts of the present invention and generally designated by the reference numeral 10 will be described.

More specifically, the illuminated dive mask 10 of the instant invention essentially comprises a continuous rim 11 having a mask lens 12 contained therewithin, typically of transparent construction. A continuous flexible mask skirt 13 extends from the continuous rim 11 in surrounding relationship relative to the mask lens for sealing engagement with an individual's face, in a manner known in the prior art. A securement strap 14 having a plurality of ends is mounted to the skirt, where at least one of the ends including a resilient battery housing 15 is secured to the strap 14 adjacent the skirt 13. The mask skirt 13 includes a skit top wall 16, with illumination housing 17 mounted to the skirt top wall 16 arranged substantially parallel relative to the rim 11 adjacent thereto. The illumination housing 17 includes a transparent illumination housing front wall 18, with a housing top wall 19 having a plurality of lens openings 23, with each lens opening including a transparent lens 23*a* therewithin. Each of the transparent lenses 23*a* is spaced below the illumination housing top wall 19 to permit the mounting of a translucent lens cap 20 over an associated transparent lens 23*a*, with each lens cap 20 of a coloration to permit various signalling and identification of an individual below a surface of water. The translucent lens cap 20 includes a sealing skirt 22 for secured projection within the lens opening 23 to provide for frictional engagement of the lens cap 20 to modify coloration directed through an associated transparent lens 23*a*.

The illumination housing 17 includes an illumination bulb 21 in alignment with each transparent lens 23*a* and lens opening 23. An electrical communication line 24 extends from the illumination bulbs 21 to the battery housing 15, wherein a battery member 26 contained within the battery housing 15 is in operative communication with the illumination bulbs 21 through a battery housing switch 25 contained within the battery housing and operative upon depressing the switch through the resilient battery housing 15. In this manner, actuation of the bulbs 21 is availed through depressing the switch 25 through the displacement of the battery housing 15.

The FIGS. 6–8 indicates the use of a reflector hood 27 arranged for mounting over each of the lens openings 23 as an optional feature of the invention, wherein each reflector hood 27 includes a lower semi-annular end 28 having a plurality of L-shaped legs 30. The L-shaped legs 30 are received within a top wall annular groove 29 arranged concentrically relative to the lens opening 23 and associated lens 23*a*. The hood 27 includes a reflective interior surface for directional reflection of illumination from the housing 17. The FIG. 10 indicates the organization having a housing adapter flange 31 for securement to a flexible band 32 as an optional manner of mounting the housing 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An illuminated dive mask, comprising, a continuous rim, having a mask lens contained within the rim, and a flexible mask skirt projecting from the rim, and a securement strap mounted to the mask skirt, with the securement strap having at least one end including a battery housing mounted to the strap in adjacency to the mask skirt, the mask skirt having a skirt top wall, and an illumination housing mounted to the skirt top wall, the illumination housing oriented substantially parallel to the rim, and the illumination housing having a housing top wall, and a plurality of illumination bulbs contained within the housing, and a plurality of lens openings directed through the housing top wall, with each lens opening positioned in alignment with one of said illumination bulbs, and a plurality of transparent lens members, and one of said transparent lens members mounted within each of said lens openings, and electrical connection line directed through the mask skirt in communication with the battery housing, and a battery member mounted within the battery housing, and switch means mounted within the battery housing for effective selective illumination between the battery and the illumination bulbs.

2. A dive mask as set forth in claim 1 wherein the battery housing is resilient.

3. A dive mask as set forth in claim 2 wherein each transparent lens is positioned below the housing top wall, and at least one translucent lens cap of a contrasting coloration relative to the transparent lens, wherein the lens cap includes a lens cap skirt, the lens cap skirt received within one of said lens opening within the housing top wall.

4. A dive mask as set forth in claim 3 including at least one reflector hood, the at least one reflector hood having a lower semi-annular end, and the reflector hood including a reflective interior surface, and a plurality of L-shaped legs mounted to the lower semi-annular end, and a top wall annular groove mounted about at least one of said lens openings within the housing top wall, with the L-shaped legs positioned within the groove rotatably mounting the reflector hood relative to the housing top wall.

* * * * *